United States Patent [19]

Lahman

[11] Patent Number: 4,746,115

[45] Date of Patent: May 24, 1988

[54] EXERCISING DEVICE WITH CONTROLLABLE FORCE PATTERN

[76] Inventor: Thomas E. Lahman, 5133 N. 32nd Pl., Phoenix, Ariz. 85018

[21] Appl. No.: 23,855

[22] Filed: Mar. 9, 1987

[51] Int. Cl.[4] ..... A63B 21/00

[52] U.S. Cl. ..... 272/130; 272/134

[58] Field of Search ..... 272/117, 118, 130, 134, 272/135, 138, 129

[56] References Cited

U.S. PATENT DOCUMENTS

| | | | |
|---|---|---|---|
| 3,902,480 | 9/1975 | Wilson | 128/25 |
| 3,905,599 | 9/1975 | Mazman | 272/118 |
| 4,063,726 | 12/1977 | Wilson | 272/130 |
| 4,093,213 | 6/1978 | Coker et al. | 272/118 |
| 4,208,049 | 6/1980 | Wilson | 272/138 |
| 4,227,689 | 10/1980 | Keiser | 272/130 |
| 4,257,593 | 3/1981 | Keiser | 272/130 |
| 4,397,462 | 8/1983 | Wilmarth | 272/130 |
| 4,406,454 | 9/1983 | Dean | 273/1 GC |
| 4,441,708 | 4/1984 | Brentham | 272/130 |
| 4,482,152 | 11/1984 | Wolff | 272/130 |

*Primary Examiner*—Richard J. Apley
*Assistant Examiner*—J. Welsh
*Attorney, Agent, or Firm*—Warren F. B. Lindsley

[57] ABSTRACT

An exercising device utilizing a pneumatic piston and cylinder as the resistive element together with a force controlling mechanism that provides a continuously changing mechanical advantage throughout the course of the exercising stroke. Adjustment devices are provided for the control of both the magnitude and the rate of change of the resistive force as needed to achieve a constant apparent force. Convertible benches and accessories permit the practice of a wide variety of exercise routines using the exercise device.

10 Claims, 5 Drawing Sheets

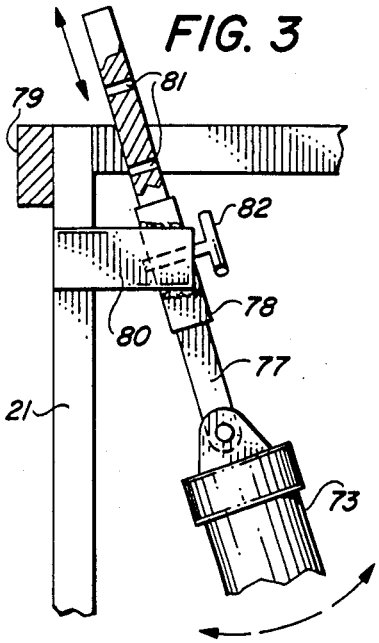
FIG. 3
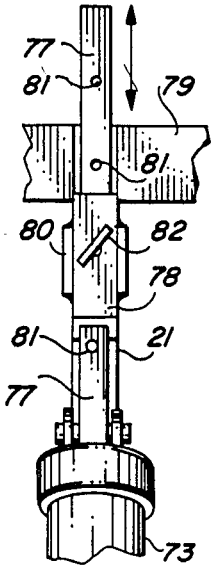
FIG. 4
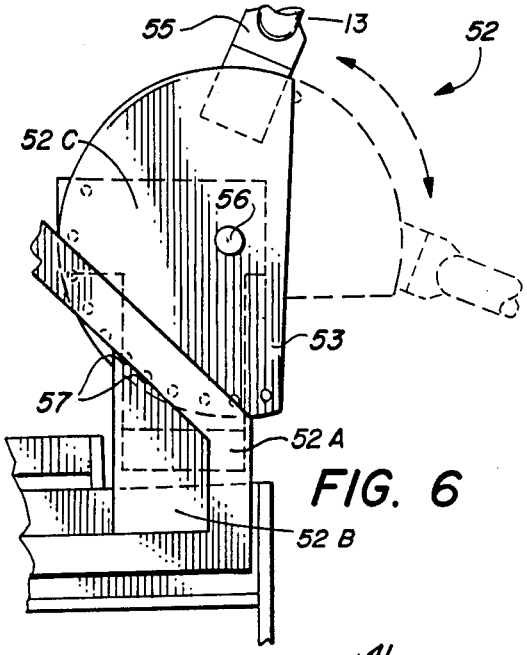
FIG. 6
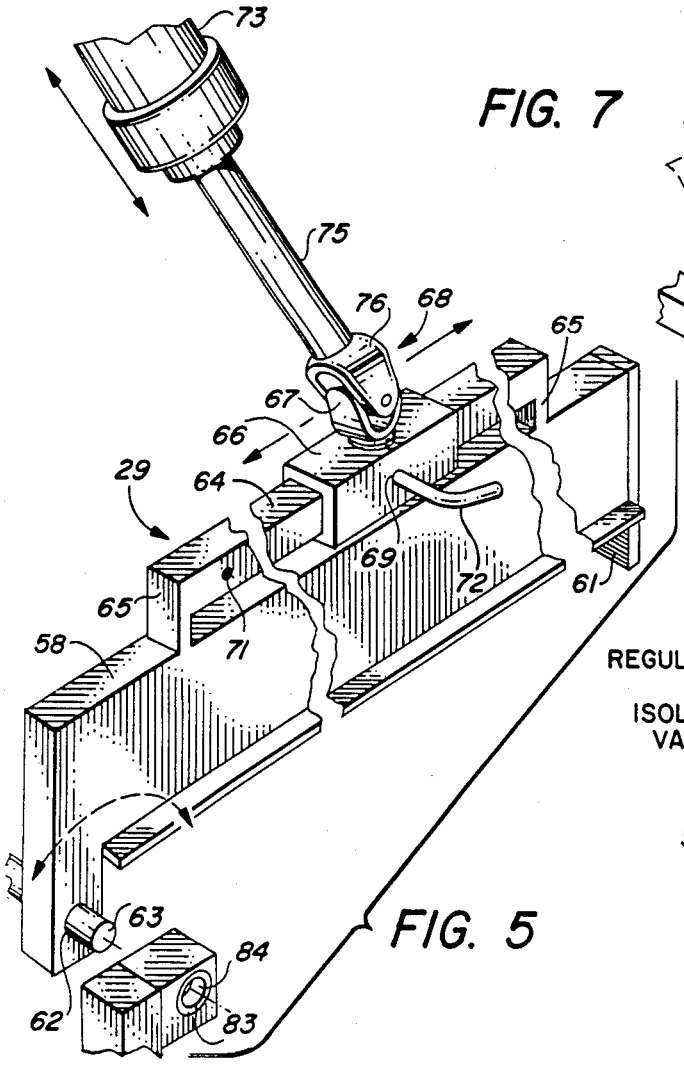
FIG. 7
FIG. 5
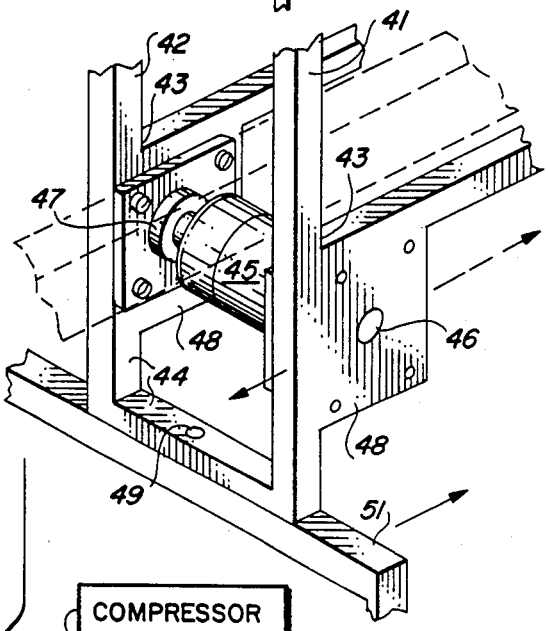
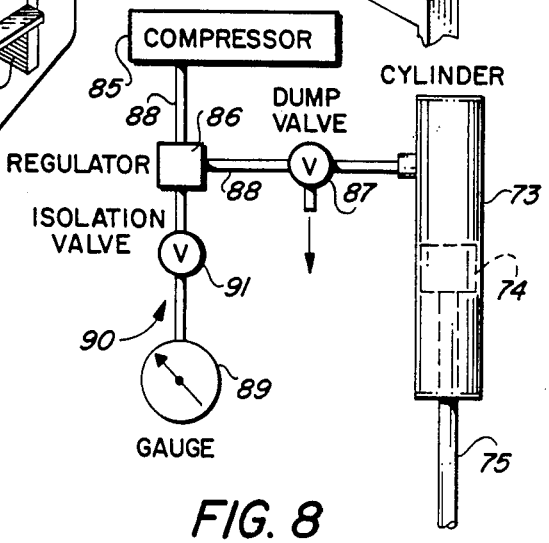
FIG. 8

FIG. 14
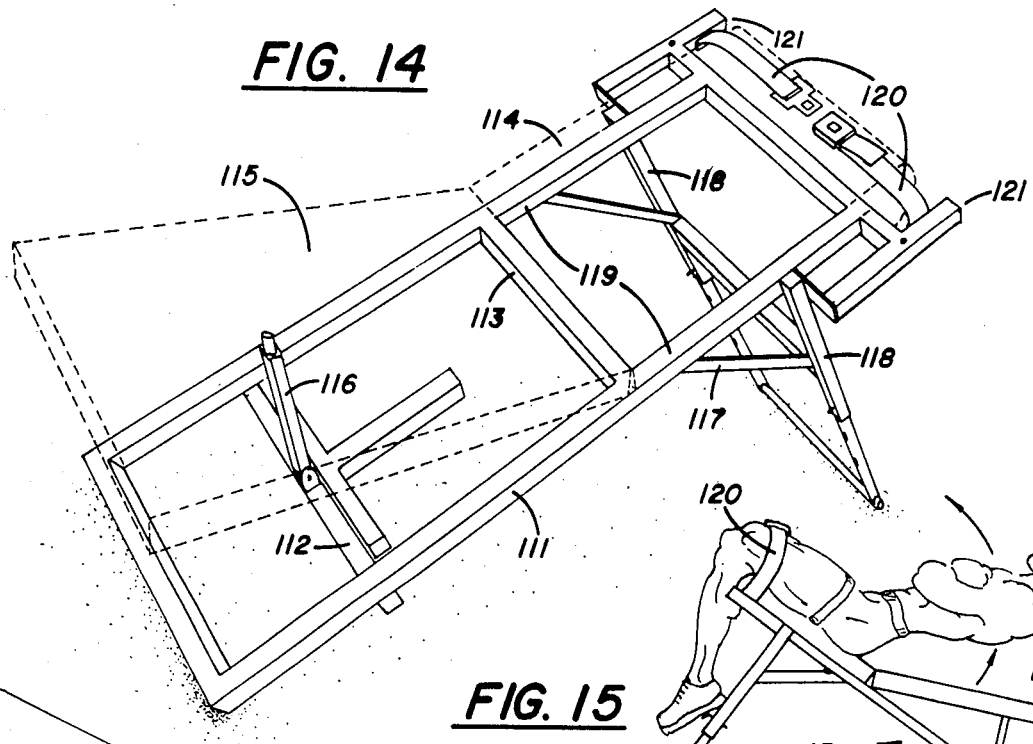
FIG. 15
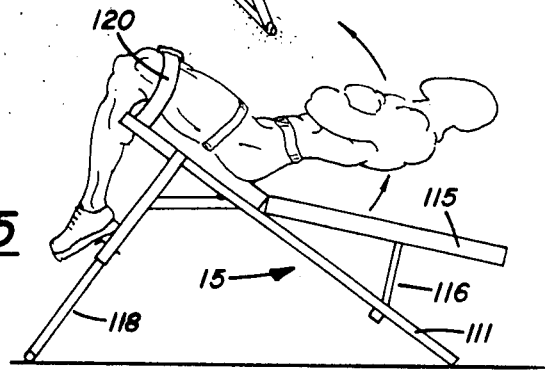
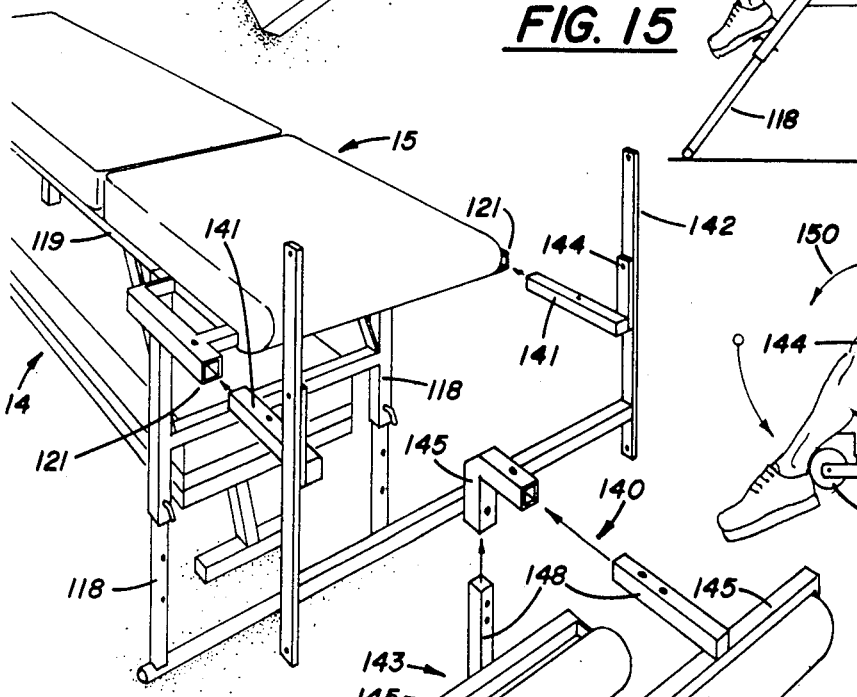
FIG. 16
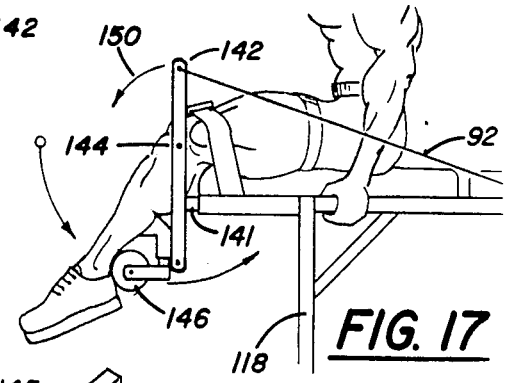
FIG. 17
FIG. 18
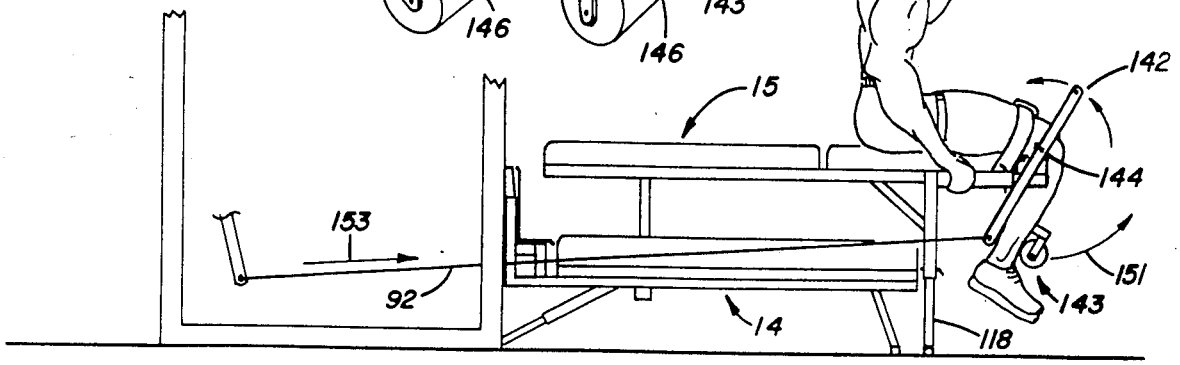

EXERCISING DEVICE WITH CONTROLLABLE FORCE PATTERN

BACKGROUND OF THE INVENTION

It has long been the practice with those directly interested in undertaking a physical fitness or body building program to utilize the conventional weight lifting devices, such as the common barbell or dumbbell training sets, for the purpose of systematically performing various isotonic exercises which provide for a toning of selective muscles throughout the body. That such exercises are desirable for individuals of all backgrounds and status is readily apparent from the current interest and enthusiasm that has been generated by both the medical profession and physical fitness advocates who urgently recommend that all members of the general public discipline themselves to a form of systematic and individually oriented physical fitness program.

In performing body firming exercises, it is necessary, to achieve maximum effect, that the selective skeletal muscle or muscles toward which the physical exertion is directed not only be tightened and hardened during the exercise, but should likewise concurrently be alternately contracted and extended to achieve maximum toning and development. Muscle construction is basically a formation of tissue which is fibrous in content, and to simply tighten this fibrous tissue in performance of an exercise without stretching or contracting the muscle fails to provide its full development. For this reason, the so-called isometric exercises which are designed to acquire body toning by stationarily pitting ones muscular strength against an immovable object fails to achieve maximum effect. Also, other body exercises performed during calisthenics do provide selective body movement and accompanying expansion and contraction of muscle tissue, but fail to acquire maximum efficiency in muscle development because such exercises do not incorporate the use of supplemental resistance to concurrently force exertion of the muscle to its maximum endurance. The most effective form of body building exercises combines selective body movements directed towards one or more muscles while incorporating the use of extrinsic resistance to force the muscle to function under pressure. For this reason, exercises performed while using the common weight lifting devices are very effective for achieving body development to its fullest and resulting physical fitness.

Various problems are readily manifested to those exercising with the common form of weight lifting devices that are presently available upon the market. To undertake a complete program of physical fitness with the use of a standard set of free weights ordinarily requires the acquisition of hundreds of pounds of various weighted plates and other accessories requiring large amounts of floor space. Such weight lifting sets are difficult to transport, because of the many loose components of excessive weight. Furthermore, the use of free weights can be dangerous and should not be undertaken without a training partner or assistant.

Another deficiency of the common weight lifting devices is the absence of a means for controlling the force experienced by the user during the course of a given exercising stroke. Due to the biomechanics of the human body, the leverage exerted by the muscles on the bones varies with the position of the bone being acted on. Typically, a muscle is at its weakest leverage point when fully extended, with a general increase occurring as contraction progresses. This is most obvious in the long bones. In an arm or leg press, for example, at the start of the stroke while the elbows or the knees are bent to the limit the exercised muscles are fully extended, and there is a minimum driving capability. Then, as the stroke progresses with the arms or legs extending to a greater degree, the driving capability increases. The same is true for a curling exercise. With the arms fully extended, the mechanical advantage of the muscle and joint configuration is very low in terms of overcoming a force that resists the bending of the elbows. Then, as the stroke proceeds with the elbows bending more and more, the mechanical advantage increases. It is, therefore, desirable in the cases discussed, that the force produced by the exercising device should be relatively low at the initiation of an exercising stroke and should increase as the stroke progresses. Furthermore, the rate at which the force increases with displacement should also be controllable. Ideally, such a controlled force pattern should conform with body strength as it varies with position, so that the apparent resistive force remains constant throughout a given exercising stroke.

DESCRIPTION OF THE PRIOR ART

Various types of exercising equipment departing from the form of the conventional weight lifting sets are described in the prior art.

U.S. Pat. No. 3,902,480 discloses an exercising system in which electromechanical devices are controlled electronically in a wide variety of operating modes. Included is a "normal" mode in which resistance is constant during the lifting or "positive" stroke, and during the lowering or "negative" stroke. There is also a "positive only" mode in which resistance is effective only during the "positive" stroke, and there is a "negative only" mode in which resistance is applied only during the "negative" stroke. In another mode, resistance is provided in both "positive" and "negative" strokes, but at different levels. Force is produced by a hydraulic system incorporating a piston and cylinder arrangement.

U.S. Pat. No. 4,063,726 discloses an enhanced version of the exercising system just described in which a capability is provided for controlling electronically the force against which the user acts, the force being either constant at any desired level, or variable as a function of position.

U.S. Pat. No. 4,208,049 discloses a device comprising an arrangement of constant load springs that are chosen individually or in groups to provide a selected constant load force on a foot or hand grip, movable bar or mechanism. The springs replace the weights of the conventional weight lifting set and the device permits simulation of various exercise routines commonly practiced with weight lifting sets.

U.S. Pat. No. 4,227,689 discloses an exercising device comprising a pneumatic system and a linkage arrangement incorporating a pair of pivot points with means for controlling the pivot point about which a rotating member operates, thereby avoiding, to a degree, control over the resistive force offered by the device.

U.S. Pat. No. 4,257,593 discloses another exercising device comprising a source of compressed gas, a reservoir or chamber of adjustable capacity as a means for providing resistance against displacement of a movable member relative to a frame. The device is adaptable to various exercising routines. It eliminates the inertial aspects of conventional weight lifting sets which may be utilized to the user's advantage once movement is initiated, and requires the user to exert the same or greater muscular force at the upper reaches of the exercising stroke that is applied initially.

U.S. Pat. No. 4,397,462 discloses a pneumatic exercising device using a lever arm that is worked against a pneumatic cylinder. The cylinder is connected to a relatively large reservoir so that the pressure and resistive force remain essentially constant throughout the motion of the lever arm.

U.S. Pat. No. 4,406,454 discloses an arm wrestling device comprising a handle extending upwardly from the top of a cabinet, the handle being coupled by gears and levers to a pneumatic cylinder. Cylinder pressure is controllable by means of an air compressor.

U.S. Pat. No. 4,441,708 discloses a leg curl exercising device incorporating a pair of pneumatic cylinders that offer substantially constant resistance to motion in either direction.

While these and other exercising devices provide alternatives to the conventional weight sets and eliminate some of the problems associated therewith, none of these prior art devices offers the type of controlled resistance needed to achieve the desired constant apparent force for the user of the exercising device.

SUMMARY OF THE INVENTION

In accordance with the invention claimed, an improved exercising and body building apparatus is provided as a replacement for the conventional weight lifting set. The improved apparatus incorporates a pneumatic piston in an arrangement of levers wherein the point of effort moves as the piston displacement progresses so that the force experienced by the user of the apparatus varies at a desired rate as the exercising stroke progresses. The perceived resistance can be stable, increase or decrease as the stroke progresses.

It is, therefore, an object of the present invention to provide an improved exercising apparatus.

Another object of this invention is to provide an exercising apparatus that does not utilize the heavy, cumbersome, difficult-to-transport and noisy-in-use weight sets.

A further object of this invention is to provide such an exercising apparatus in a form that permits the simulation or practice of all the conventional exercises commonly practiced with the use of a conventional barbell or weight set.

A still further object of this invention is to provide such an apparatus in a relatively compact form that is readily transportable.

A still further object of this invention is to provide such an apparatus in a form that is collapsible to relatively compact dimensions from the opened or extended form required during use so that the apparatus will not occupy an undesirably large storage space while not in use.

A still further object of this invention is to provide in such an apparatus a means for controlling or adjusting the force produced during a given exercising routine.

A still further object of this invention is to provide in such an apparatus a means for causing the force produced to vary with displacement as the exercising stroke progresses.

Yet another object of this invention is to provide in such an apparatus a means for controlling the rate at which the force varies with displacement.

Further objects and advantages of this invention will become apparent as the following description proceeds, and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings, in which:

FIGS. 3 and 4 are enlarged side and front views, respectively, of a rate control means incorporated in the mechanism for controlling the rate at which force is increased by the mechanism through the course of an exercising stroke;

FIG. 5 is an enlarged perspective view of a portion of the mechanism incorporating a means for selecting the point of effort exerted by the pneumatic cylinder rod on a lever indirectly actuated by the exercise movement. The object is to provide three overlapping ranges of resistance;

FIG. 6 is an enlarged side view of a portion of the mechanism incorporating a means for adjusting the angle or position of the hand grips employed in certain exercise routines;

FIG. 7 is an enlarged perspective view of a portion of the mechanism incorporating a roller that moves along a lever or rail to continuously adjust a point of effort, thereby compensating for the continual increase in force required to further compress the air within the pneumatic cylinder as the exercise motion progresses;

FIG. 8 is a functional block diagram showing the pneumatic system incorporated in the exercising device of the invention;

FIG. 14 is a partial perspective view of the upper exercise bench illustrating a means for positioning the bench in various positions;

FIG. 15 is an illustration showing an alternate use of the upper exercise bench as an inclined sit-up bench in an exercise not utilizing the force controlling mechanism of the exercising device;

FIG. 16 is a perspective view showing accessories that are attached to the end of the upper exercise bench during the practice of leg exercises including leg curls and thigh extensions; and FIGS. 17 and 18 are side views showing the use of the exercise device including the upper exercise bench and the accessories of FIG. 16 in use during the practice of leg curls and thigh extensions, respectively.

DESCRIPTION OF THE PREFERRED EMBODIMENT

Figure 1:
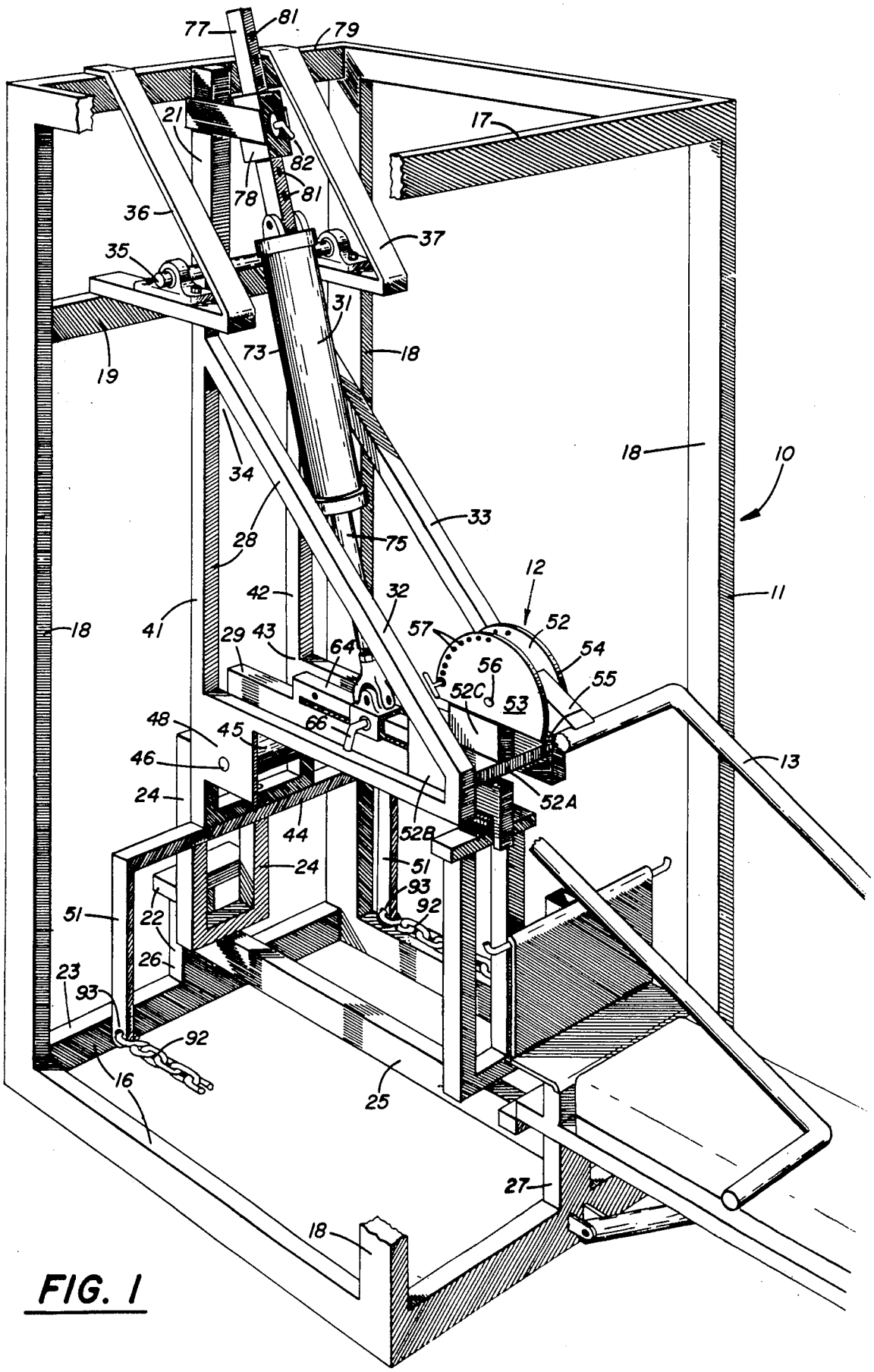
FIG. 1 is a perspective view partially broken away of the exercising device of the invention.

Referring more particularly to the drawings by characters of reference, FIGS. 1–18 show an exercising device 10 embodying the invention comprising a frame 11, a force controlling mechanism 12, a user interaction means comprising an exercise bar 13, a lower exercise bench 14 and an upper exercise bench 15.

Frame 11 is constructed of tubular steel of a square or rectangular cross section with its base 16 comprising an approximately square picture frame configuration approximately three feet on a side. A similar square framework comprises a top 17 of frame 11 which is supported at its four corners by four vertical members 18 extending upward from the four corners of base 16. Members 18 are approximately six feet in length.

A horizontal cross member 19 positioned near the top and at the rear side of frame 11 and an associated vertical stiffener bar 21 extending from the center of member 19 upwardly to the rear member of top 17 serve as upper mounting supports for mechanism 12.

A T-shaped member 22 extending upwardly from the center of a horizontal base member 23 at the rear side of frame 11 supports a U-shaped frame 24 which, in turn, is supported equally by stiffener bar 25, serves as a lower stop for mechanism 12. The horizontal stiffener bar 25 extends from the vertical leg 26 of member 22 to a vertical support 27 near the base 16 at the front side of frame 11.

Mechanism 12 comprises a triangular swinging frame 28, a pivoting rail 29 and a pneumatic cylinder member 31.

Swinging frame 28 comprises two spaced apart open triangular sides 32 and 33 having the form of nearly right triangles with two oblique angles of approximately 45 degrees each.

Figure 2B:
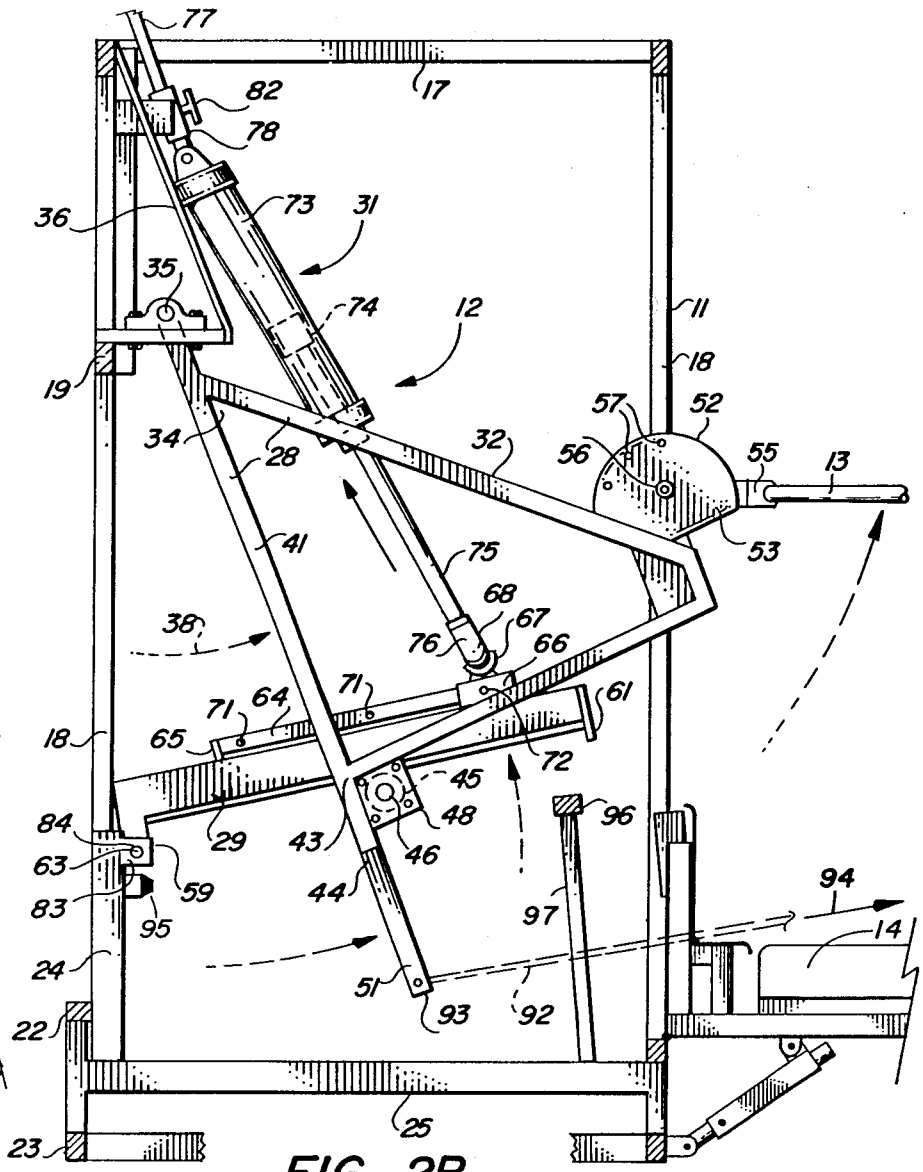
FIGS. 2A and 2B are partial side views of the device of FIG. 1 showing the force controlling mechanism of the device in two different positions.
Figure 2A:
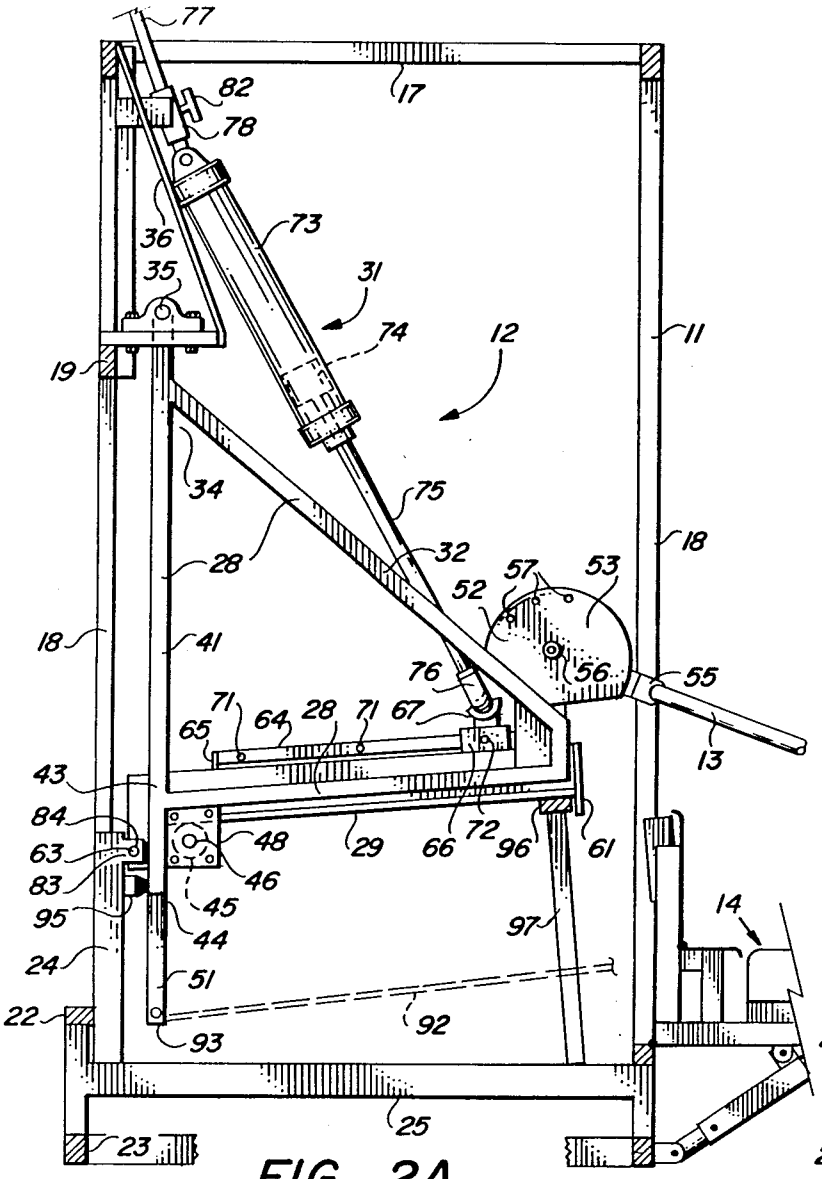
Figure 11:
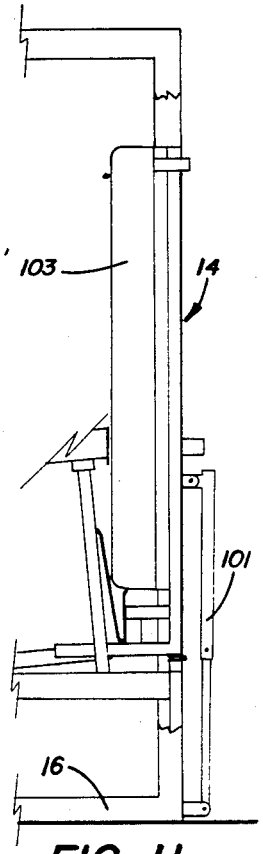
FIG. 11 is a side view of the exercising device showing the exercising bench in a stored position.

As shown in FIGS. 2A and 2B, frame 28 is pivotally supported near the apex of one of the 45 degree angles 34 by a pivot pin 35. Pin 35 is carried by two triangular pivotal support brackets 36 and 37. Brackets 36 and 37 are mutually parallel and are spaced apart sufficiently to permit the interposition of swinging frame 28 therebetween. Brackets 36 and 37 are secured to rear frame member 19 and to the rear horizontal member of top 17 with the biangular brackets 36 and 37 positioned to locate the pivotal support pin 35 a short distance forward of the rear wall of frame 11. Frame 28 is thus rotational about pin 35 as indicated by arrow 38 in FIG. 2B.

Legs 41 and 42 of triangular frames 32 and 33, respectively, that extend downwardly from pivot pin 35, extend past the angles 43 of the two frames 32 and 33, and at their culmination are connected by a horizontal member 44 that holds the two frames 32 and 33 apart in a fixed relationship with each other. Bridge member 44 is shown more clearly in FIG. 7, which also shows a unitary roller 45 and axle 46 configuration of which is transversely mounted between frames 32 and 33 adjacent the apexes of their angles 43. Axle 46 is mounted by means of bearings 47 held by square webbing areas 48 that project from frames 32 and 33. Pivotally mounted to the underside of bridge 44 by means of a pin 49 is a yoke 51. Yoke 51 has an upside down U-shaped configuration with pin 49 passing through the centers of the base portions of the U configurations of bridge 44 and yoke 51, so that yoke 51 is centered below bridge 44 and rotates about a vertical axis that passes vertically through the center of bridge 44. Yoke 51 may be formed by bending a long metal strip.

An adjustable mounting fixture 52 for the support of exercise bar 13 is mounted between the forward ends of frames 32 and 33 upon a transverse metal plate or bar 52A the plate being joined at its ends to the inside faces of plates 52B welded to frames 32 and 33. The transverse plate serves the further purpose of fixing the spacing between frames 32 and 33, and it secures their positions relative to each other at that point. As shown in FIGS. 1, 2A, 2B and 6, fixture 52 comprises two mutually parallel metal plates 53 and 54 having matching configurations in the form of circles from which an edge or segment has been removed. The parallel semicircular segments are welded to opposite faces of a bar 55 having a square or rectangular cross section. Fixture 52 is rotationally mounted about a pivot pin 56 that passes through the centers of plates 53 and 54 and through a hole in an upright member 52C secured to the transverse metal plate or bar 52A. In the mounted position of fixture 52, plates 53 and 54 are vertical and parallel with the planes of frames 32 and 33. Exercise bar 13 has one end secured inside an axial bore of bar 55 so that bar 13 extends radially outward therefrom and is rotational with plates 53 and 54 about pin 56. The rotation of bar 13 about pin 56 permits the raising or lowering of bar 13 to accommodate different forms of exercise. To secure the desired position of bar 13, a locking pin is passed through one of several holes 57 distributed about the peripheries of the plates 53 and 54, the pin passing also through a hole or opening in a fixed member 52C that is interposed between the two plates.

Pivoting rail or lever 29, as shown most clearly in FIGS. 2B and 5, comprises a long bar 58 of rectangular cross section having perpendicular downward extensions 59 and 61 at the rear and forward ends, respectively.

The lower end of extension 59 is pierced transversely by a circular opening 62 to receive a pivot pin 63, with extension 61 serving as a stop for roller 45 on which the lower surface of bar 58 rests when lever 29 is assembled with frame 28 in mechanism 12.

Spaced upwardly from bar 58 and parallel therewith, is a second bar 64. Bar 64 also has a square or rectangular cross section, and it extends from the forward end of bar 58 toward its rear end where it is secured to bar 58 by means of bridges 65, one at each end thereof. The spacing between bars 58 and 64 is adequate to provide clearance for a sleeve 66 that fits over bar 64, and is movable thereon from one end to the other thereof.

Sleeve 66 has a first member 67 of a universal joint 68 secured to its top surface. Its two side walls are pierced by aligned holes 69 in opposite walls of sleeve 66, which may be aligned with any one of a number of transverse horizontal holes 71 distributed along and through the cross section of the length of bar 64. Sleeve 66 may be secured in position along bar 64 by aligning holes 69 with one of the holes 71 and passing a pin 72 through the aligned holes.

Pneumatic member 31 comprises a cylinder 73 and a piston 74 that works inside cylinder 73 at the end of a shaft 75, the shaft extending from the lower end of cylinder 73. The lower end of shaft 75 is attached to a second member 76 of universal joint 68. The upper end of cylinder 73 is pivotally secured to the lower end of a bar 77. Bar 77 passes through a mating sleeve 78. As shown most clearly in FIGS. 3 and 4, sleeve 78 is secured at an inclined angle by means of a bracket 80 to stiffener bar 21 at the center of the rear member 79 of frame 11. Holes 81 spaced along the length of bar 77 may be aligned with holes in sleeve 78, and secured at a number of positions therein by passing a pin 82 through the aligned holes.

Frame 24 which is supported as described earlier by member 22 at the rear wall of frame 11 near base 16, has a perpendicular extension 83, as shown in FIGS. 2A and 2B, at the top of each of its two vertical sides. Each extension 83 is directed horizontally forward and each is pierced by a circular hole 84, the two holes 84 being aligned with each other. Bar 29 is pivotally mounted to these holes by interposing its extension 59 between the two holes, aligning hole 62 of extension 59 with holes 84 of extensions 83 and passing pivot pin 63 through holes 62 and 84. When properly mounted in this manner, lever 29 extends forward from frame 24 and passes over the top of roller 45 of swinging frame 28 and between sides 32 and 33 of frame 28.

The functional block diagram of FIG. 8 shows elements of the exercising device not shown in the other drawings. The elements are, nevertheless, essential to the operation of the device. As indicated by FIG. 8, a compressor 85 supplies compressed air to cylinder 73 by way of a regulator 86 and a dump valve 87. Pneumatic lines 88 connect compressor 85 to regulator 86, regulator 86 to valve 87 and valve 87 to cylinder 73. A pressure gauge 89, connected to regulator 86 via an isolation valve 91 displays the operating pressure. Valve 87 may be operated to relieve pressure in the system. In the operation of the pneumatic system 90 of FIG. 8, the compressor 85 delivers compressed air to cylinder 73 at any time the pressure in cylinder 73 falls below the pressure level set and controlled by regulator 86, thereby preventing the pressure in cylinder 73 from falling at any time below the regulated level. The pressure inside cylinder 73 may, however, be driven above the regulated level through the action of piston 74 when it is driven upward by external forces operative upon shaft 75 to compress the air contained in cylinder 73.

The operation of the force controlling mechanism 12 is most readily described with reference to FIGS. 2A and 2B, FIG. 2A showing the position of the mechanism at the start of an exercising stroke, and FIG. 2B showing the position of the mechanism at a point part way through the exercising stroke. It is of no consequence relative to the present operational description whether the mechanism is operated by manual force applied to the exercise bar 13 to raise it, or whether manual force is coupled to the mechanism via chains 92 connected at the lower ends 93 of yoke 51, the chain 92 being drawn in the latter case in the direction of the arrow 94, shown in FIG. 2B.

In the initial position of the mechanism 12, as shown in FIG. 2A, frame 28 pivots downward about its mounting point at pin 35 under the force of its own weight or cylinder pressure, its rest position being determined and supported by a first rubber tipped bumper 95 that extends forward from its mounting point on the forward surface of frame 24 just below extension 83. The rest position of rail 29 under the same condition is supported and restrained by a second rubber tipped bumper 96 that is carried at the top of a vertical post 97, the lower end of which is secured to the top of stiffener bar 25 of frame 11.

In the rest position of mechanism 12, piston 74 is seen to be withdrawn almost to the lower end of cylinder 73, and roller 45 is supporting the pivotally mounted lever 29 near its pivot point (as seen in FIGS. 2A and 2B).

As swinging frame 28 is now pivoted counterclockwise about pin 35 under the influence of manual force applied to bar 13, or via chain 92, roller 45 swings toward the right in an arcuate path, the vertical component of which increases as the displacement progresses. Lever 29, which rests upon roller 45, is moved upward accordingly against the counter force applied by pneumatic member 31 and, more particularly, by piston 74 through its shaft 75.

It will be recognized at this point, that two opposing forces are operative upon lever 29. The first is the manual force operative at roller 45 and urging an upward rotation of lever 29 about its pivot pin 63; the second is the downward force applied by shaft 75 at its point of attachment to sleeve 66. Associated with each force is a moment arm defined by the distance of the point of application from the pivot pin 63. The longer the moment arm, of course, the greater is the mechanical advantage associated with each force.

It will now be seen that while the moment arm of the counter force or resistive force applied by shaft 75 of piston 74 remains relatively constant as the stroke progresses, the moment arm associated with the manual force increases by virtue of the motion of roller 45 along its arcuate path which carries its point of pressure contact with lever 29 ever farther removed from pin 63, thereby increasing the moment arm and the mechanical advantage associated with the manual force.

At the same time, the piston 74 is being moved upward inside cylinder 73, compressing the air confined within cylinder 73 and thereby increasing accordingly, the opposing counter force applied to lever 29 by piston 74.

Three variables are thus seen to be operative simultaneously in controlling the magnitude of the manual force that must be applied to move bar 13 or chain 92. The first variable is the upward component of the arcuate path taken by roller 45 which increases as the stroke progresses. The increasing upward component decreases the mechanical advantage associated with the manual force. The second variable is the increasing moment arm resulting from the motion of roller arm 45 which increases the mechanical advantage for the manually applied force. The third variable is the increasing pressure in cylinder 73 which increases the required manual force.

The third variable is operative in and typical of other state of the art exercise devices utilizing a pneumatic piston and cylinder arrangement as a restraining mechanism. The increasing restraint afforded by the piston with stroke progression is desirable in the sense that its variation is in the desired direction for most forms of exercise. The increasing force is needed to offset the increase in physical strength that occurs, for example, during a bench press as the weight is moved farther from the chest. Ideally, an apparently constant force is achieved when the increase in physical strength is first offset by the increased force of the countering mechanism. Unfortunately, most state of the art mechanisms of this type are not sufficiently adjustable to permit the realization of a satisfactory balance. In other cases, the adjustment range is so severely limited that it is of little value.

The present invention incorporates a number of adjustment means which may be employed to achieve the desired force pattern and a close balance.

A first adjustment that can be made is the air pressure delivered to cylinder 73 by compressor 85. Low pressure results in a correspondingly low counter force produced by the mechanism, and the counter force can be conveniently increased by simply raising the operating pressure.

A second adjustment that produces essentially the same effect, but provides a very significant increase in adjustment range, involves the positioning of sleeve 66 along bar 64. In the position shown in FIGS. 2A and 2B, a maximum moment arm and mechanical advantage is provided for the counter force from element 31. To reduce the mechanical advantage of the counter force and at the same time the length of traverse of piston 74, the sleeve 66 is moved to the left and secured at a hole 71 closer to pivot pin 63. Various combinations of compressor pressure and sleeve position may be employed to achieve a wide range of counter force adjustments. This same adjustment also affects the rate at which the counter force changes with the progression of the exercising stroke. With sleeve 66 moved all the way to the right, as shown in FIGS. 2A and 2B, the length of traverse of piston 74 is at a maximum. As sleeve 66 is moved to the left, the traverse of piston 74 decreases with minimum traverse achieved when sleeve 66 is secured at the left-hand end of bar 64. The length of traverse of piston 74 affects the rate at which the counter force changes with stroke progression. For purposes of this description, this rate of change will hereinafter be referenced as gain. Thus, the primary purpose of sleeve 66 is to provide three overlapping ranges of resistance. The ranges are necessary to compensate for limitations of the air pressure regulator, and to allow finite readings of the dial face. It also reduces compressor requirements. The range is selected first, then the gain is adjusted, as described in the following paragraph.

A third adjustment is made by altering the position of bar 77 in sleeve 78. As shown in FIGS. 2A and 2B, bar 77 has been moved to its fully upward position which extends pneumatic element 31 to a maximum degree. In this extended condition, the active length of cylinder 73 is greatest so that for a given length of stroke of piston 74, a minimum ratio of maximum to minimum pressure is achieved. As bar 77 is moved to lower positions within sleeve 78, the active length is reduced, the piston stroke covers a greater part of active length and the pressure ratio increases accordingly. Because cylinder pressure at the rest condition is controlled by the regulator 86, this adjustment does not affect force at the beginning of the stroke. The variation in gain that is realized by altering the position of bar 77 does, however, alter the magnitude of the counter force achieved at the end of the stroke.

The independent gain adjustment afforded in connection with adjustable bar 77 is useful in offsetting the change in gain that occurs when sleeve 66 is moved along bar 64 to alter the overall mechanical advantage of the counter or opposing force.

The three adjustment means provided, including compressor pressure, the point of counter force application along lever 29 and the active cylinder length, thus provide a high degree of adjustment flexibility and range. The practiced utilization of these adjustment means makes it possible for the user of the equipment to achieve an apparent constant resistive force at virtually any desired resistance level or, if desired, finish the exercise movement with less or greater perceived resistance than the movement began with.

The full utilization of the force controlling mechanism 12 in connection with the practice of a wide variety of commonly practiced exercise routines is realized through its combination with two specially contrived exercise benches which, together with mechanism 12, comprise the exercising device of the invention. The two benches are the lower exercise bench 14 and the upper exercise bench 15 as referenced earlier.

Figure 9:
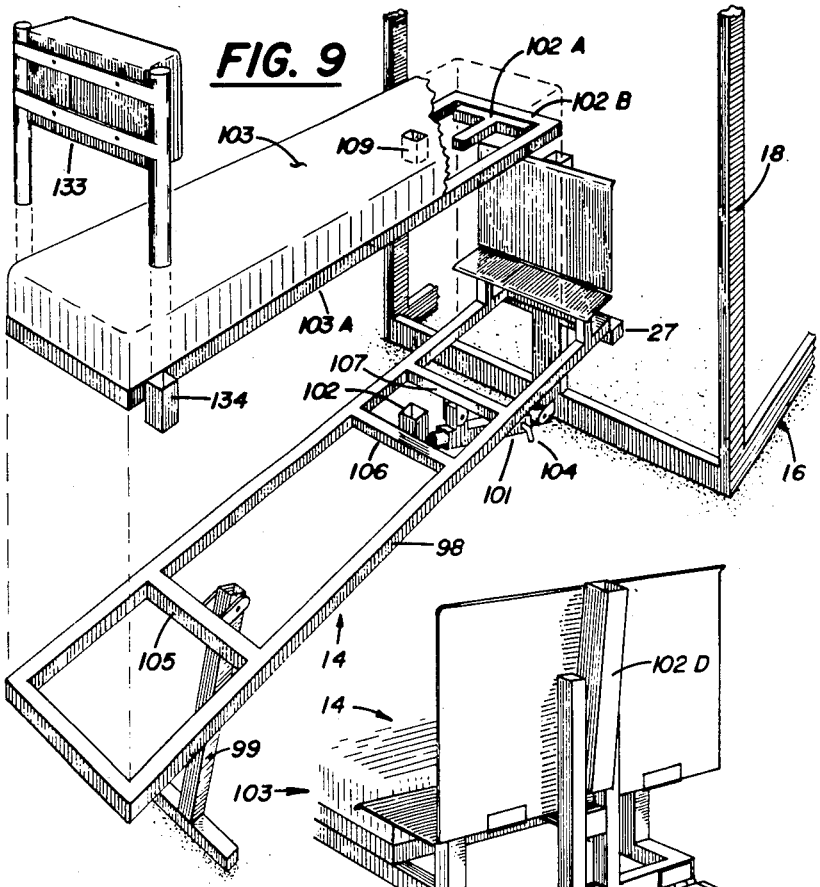
FIG. 9 is a partial perspective view of the exercising device illustrating a novel arrangement of upper and lower exercise benches incorporated in the device for use during certain exercise routines.
Figure 10:
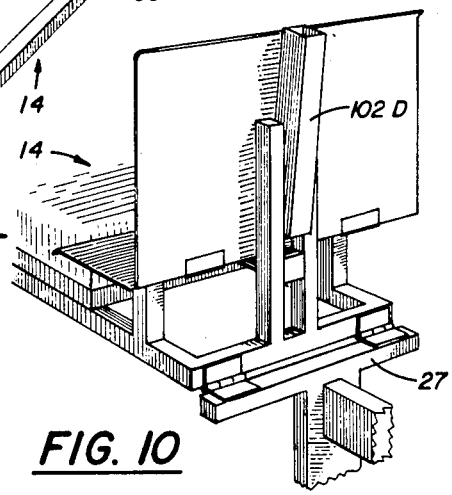
FIG. 10 is a second partial perspective view of a footrest of the exercise benches shown in FIG. 9.
Figure 12:
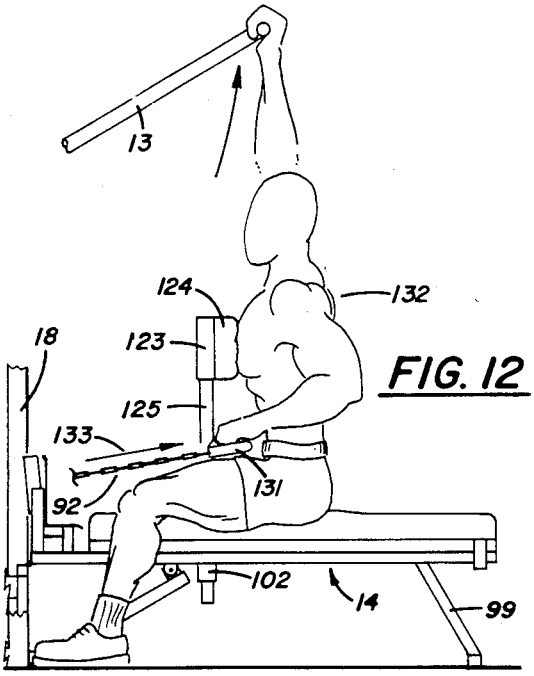
FIG. 12 illustrates the use of the lower exercise bench and the exercising device in the practice of separate exercise routines known as rowing and military press.

Lower exercise bench 14, as shown in FIGS. 9, 10 and 12, comprises a one-piece frame 98, an outboard support 99, an attachment brace 101, an accessory socket 102, a "T" shaped member 102A hinged on the underside to the cross piece 102B of the forward end of 103A and a pad 103. Details of structure are most apparent in FIGS. 9 and 10.

Frame 98 comprises a rectangular framework of tubular metal with cross members 105–107. Cross member 105 near the outboard end of bench 14 serves as an anchor for outboard support 99. Cross member 106 near the center of framework 98 holds the accessory socket 102. Cross member 107 provides support for the upper end of brace 101. Cross members 105–107 together with framework 98 provide a firm support structure for pad 103.

Outboard support 99 is made of tubular steel in the form of a "T" turned upside down. The upturned base of the "T" is welded to the side of cross member 105 at a center position. The down turned horizontal member of the "T" affords stability against any wobbling or lateral motion of bench 14 during exercise routines.

The forward end of framework 98 is hingedly attached to the top horizontal cross member 27 of frame 11. Any number of quick-connect and quick-disconnect means may be employed to secure its position thereon as, for example, pins that extend from the lower surface of framework 98 into mating holes in cross member 27.

Brace 101 attaches by a suitable pin means 104 to the center of the forward member of base 16 of frame 11, providing added security against the collapse or buckling of outboard support 99 during heavy exercise routines.

Accessory socket 102 is a hollow metal tubular stub with a rectangular or square crosssection, and is secured by welding to the side of cross member 106 at a point midway between the sides of framework 98.

Pad 103 preferably comprises a foam pad over a wood or fiberboard backing covered in plastic or other durable material, and attached to a square tubular metal frame 103A. A rectangular or square opening 109 aligned with the position of socket 102 provides clearance for an accessory support post.

Upper exercise bench 15 which also serves as an inclined sit-up bench comprises a rectangular framework 111 with cross members 112 and 113, a fixed pad 114, a larger hinged pad 115 and associated support 116, a forward mounting post 117 and braced outboard legs 118 for angular adjustment and a pair of attachable seat belts 120.

Framework 111 is made of tubular steel of rectangular or square cross section. Its long side members 119 are adaptable at their outboard ends 121 to receive various leg exercise accessories, hereinafter described with reference to FIGS. 16–18.

Pad 115 is hinged at its outboard end to cross member 112; fixed pad 114 is secured to cross member 113 and to the outboard end of framework 111. Pad 115 is held in the raised position shown in FIG. 14 by hinged support post 116, the lower end of which attaches to cross member 112. The construction of pads 114 and 115 is similar to that of pad 103.

For certain exercise routines, bench 15 is mounted over bench 14, as shown in FIGS. 16 and 19. The mounting of bench 15 over bench 14 is accomplished by inserting post 116 into socket 102 of bench 14. Socket 102 holds post 116 in a rigid upright position so that post 116 together with the two braced outboard legs 118 support bench 15 in a stable and secure position.

The alternate use of bench 15 as a stand-alone inclined sit-up bench is illustrated in FIG. 15. Bench 15 is supported at its outboard end by legs 118 while the forward edge of framework 111 rests directly upon the floor. The forward pad 115 is elevated and secured in its elevated position by brace 116, which is pivotally attached to cross member 112 to eliminate extreme curvature of the lower back of the user.

The sit-up bench exercise is performed while lying on the bench with the lower legs extended past the outboard edge of the pad; the upper body from the hips upward rest on the inclined pad, and the knees are restrained by a strap 120. The exercise proceeds with the upper part of the body rising to an upright position, then lowered and raised again in a repeated routine.

FIG. 12 shows lower exercise bench 14 along with an accessory 123 for use in the practice of rowing exercises.

Accessory 123 comprises a cushion 124 mounted atop support post 125, which fits into socket 102 for the mounting of accessory 123 on bench 14.

Also shown in FIG. 12 is the hand grip 131 with its ends attached to the chains 92 which are attached at their opposite ends to yoke 51, as shown in FIGS. 1, 2A and 2B.

The rowing exercise is practiced as shown in FIG. 12, with accessory 123 mounted in socket 102 of bench 14. The person 132 practicing the exercise sits with legs astride bench 14, facing forward with chest braced against cushion 124 and hands gripping handle or grip 131. The chain is drawn in the direction of arrow 133 as the elbows are bent during the power stroke, causing swinging frame 28 to pivot against the counter force of pneumatic element 31. At the end of the power stroke, the elbows are straightened, relaxing the tension on chain 92, and allowing mechanism 12 to return to the rest position. The exercise is continued in this manner.

As shown in FIG. 12, a military press is performed while sitting astride lower exercise bench 14, facing exercising device 10 and successively raising and lowering the exercise bar 13 which is secured directly to fixture 52 as described earlier. The raising of bar 13 is the power stroke which is resisted by the force controlling mechanism 12.

Figure 13:
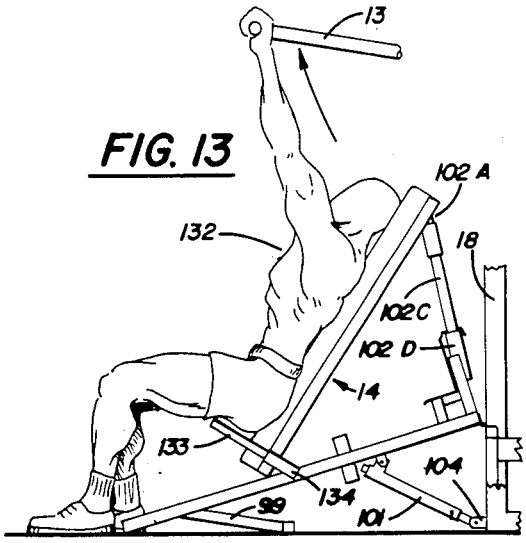
FIG. 13 illustrates the use of the exercising device and the lower exercise bench in a modified position during the practice of an exercise routine known as a bench press.

FIG. 13 illustrates the use of device 10 in the practice of a bench press exercise. The user 132 sits on a bench 133, shown more clearly in FIG. 9, which is anchored in seat sockets 134, one on each side of frame 103A of cushion 103. The exercise bench is then elevated as shown in front of device 10 and supported by inserting T-shaped member 102A into extension bar 102C which is itself inserted into receiver 102D. Alternately, extension bar 102C may be deleted, and T-shaped member 102A may be directly inserted into receiver 102D. This varies or changes the angle of effort, as illustrated by FIG. 13. The angle of effort is approximately 45° to the torso. The alternate position results in an angle of effort of 90° to the torso. The person performing the bench press lies on his or her back on the inclined bench 14, and raises bar 13 against the resistance of force controlling mechanism 12. It will be recognized that the angle of bar 13 may be adjusted by means of fixture 52 as appropriate for the practice of the military press as shown in FIG. 12, or for the bench press as shown in FIG. 13.

FIGS. 16–18 illustrate the adaptation and use of the device 10 in the practice of leg curl and thigh extension exercises.

For these exercises, a leg exercise accessory 140 is required. Accessory 140 comprises a support frame 141, a pivoting yoke 142 and a convertible roller assembly 143.

Support frame 141 comprises a tubular or solid metal member with a rectangular or square cross section that is formed or fabricated into a U-shaped frame with a width dimension corresponding to the width of upper exercise bench 15. As shown in FIG. 16, the ends of frame 141 may be inserted and pinned into the outboard ends 121 of the long side members 119 of bench 15. By this means, the frame 141 is secured for use to bench 15.

Yoke 142, preferably formed of tubular steel into a U-shaped configuration, is pivotally attached at the centers of its side members to the outside surfaces of frame 141. As shown in FIG. 16, the U-shaped configuration of yoke 142 is right side up and its pivotal mounting is accomplished by means of pivot pins 144 that pass through the side members of frame 141 and yoke 142.

A roller attachment bracket 145 is welded or otherwise secured to the center of the horizontal lower member of yoke 142. Bracket 145 is of hollow tubular steel, preferably of a rectangular or square cross section. It has an L-shaped configuration that is turned upside down in its attachment to yoke 142, so that it first projects upward and then forward from the bottom of yoke 142.

Convertible roller assembly 143 comprises a U-shaped frame 145 that carries between its open ends the axle of a padded roller 146. An attachment post 147 extends from the center of the U-shaped frame 145. Post 147 is perpendicular to the plane of frame 146. It is shaped and dimensioned so that it may be installed with a snug fit in either end of bracket 145, the end of post 148 being inserted into the hollow opening at either end of tubular bracket 145.

As illustrated in FIG. 16, roller assembly 143 may be installed in either of two positions. For leg curls, post 148 is installed in the lower end of bracket 145 with roller 146 facing outward; for thigh extensions, post 148 is installed in the upper end of bracket 145 with roller 146 hanging downward.

For practicing the two leg exercises, the chains 92 are attached either at the top two corners, or at the lower two corners of yoke 142.

FIG. 17 shows the leg exercising accessory 140 assembled and connected for use in the performance of leg curls. Frame 141 is installed at the end of bench 15. Roller assembly 143 is installed as described above at the lower end of bracket 145, and the chains 92 are attached at the top two corners of yoke 142. The person performing the exercise sits on bench 15 with his or her legs passing through the upper portion of yoke 142, the feet and ankles passing over the far side of roller 146.

Bending the knees, he/she presses the back sides of his or her heels against roller 146 driving the lower end of yoke 142 toward exercising device 10. By its pivoting action about pin 144, the top end of yoke 142 is moved away from device 10, drawing chain 92 in the direction of arrow 150, thereby raising swinging frame 28 against the resistance of force controlling mechanism 12. This is the power stroke of the leg curling exercise.

FIG. 18 illustrates the adaptation of the device 10 and the accessory 140 for thigh extension exercises. Again, the accessory 140 is installed at the end of bench 15. In this case, the roller assembly 143 is installed at the upper end of bracket 145 which causes the roller 146 to be projected forward from yoke 142. The chains 92 are attached at the lower corners of yoke 142. The person doing the thigh extension exercise again sits at the end of the exercise bench 15, his or her ankles passing in this case between roller 146 and the lower end of yoke 142, so that roller 146 presses against the front side of the ankle or against the lower end of the shin bone. The power stroke begins with the knees bent and the feet and lower legs hanging downward. As the legs then begin straightening, and the feet moving out along arc 151, chain 92 is moved in the direction of arrow 153 which again raises swinging frame 28 against the resistance of force controlling mechanism 12.

An effective and versatile exercising device is thus provided in accordance with the stated objects of the invention, and although but a single embodiment of the invention has been illustrated and described, it will be apparent to those skilled in the art that various changes and modifications may be made therein without departing from the spirit of the invention or from the scope of the appended claims.

What is claimed is:

1. An exercising device with controllable force patterns comprising:

a rigid frame, a force controlling means and a user interaction means for contacting a body part of the user for receiving user exerted forces, said force controlling means comprising a fluid operated cylinder pivotally mounted at one end to said frame and comprising a piston movably mounted in said cylinder and a piston rod attached to said piston and extending outwardly of the other end of said cylinder, and a force transmitting means pivotally mounted on said frame and connected to said user interaction means for moving said piston rod and piston responsive to user exerted forces, a lever means pivotally connected at one point to the rigid frame and at another point to said piston rod, and wherein said force transmitting means engages said lever means variably along its length, thereby effecting the movement of the piston rod to create a continuously changing mechanical advantage by continuously changing the relationship between the force transmitting means and the force controlling means.

2. An exercising device with controllable force patterns comprising:

a rigid frame, a force controlling means and a user interaction means for contacting a body part of the user for receiving user exerted forces, said force controlling means comprising a fluid operated cylinder pivotally mounted at one end to said frame and comprising a piston movably mounted in said cylinder and a piston rod attached to said piston and extending outwardly of the other end of said cylinder, and a force transmitting means connected to said user interaction means for moving said piston rod and piston responsive to user exerted forces, said force transmitting means comprises a swinging triangular frame pivotally mounted at one corner to said rigid frame adjacent said cylinder, a rail pivotally mounted to said rigid frame at a point adjacent the pivotal connection of said triangular frame, means for selectively connecting the end of said piston rod to one of a number of positions along said rail, roller means mounted on said triangular frame for engaging the under surface of said rail for rotating said rail couterclockwise about its pivot point when said triangular frame is rotated counterclockwise, and means for connecting another portion on said triangular frame to said user interaction means for counterclockwise rotation of said triangular frame during the application of the exerted forces.

3. The exercising device set forth in claim 2 in further combiantion with:

a source of regulated fluid under pressure for applying to said piston a selected pressure at said one end of said cylinder.

4. The exercising device set forth in claim 3 in further combination with:

means connected to said rigid frame for selectively positioning said cylinder relative to said piston.

5. The exercising device set forth in claim 2 wherein:

said fluid operated cylinder defines a chamber therewithin on one side of the piston which reduces in size as the piston is moved in one direction in response to said exerted forces and which increases in size as the piston is moved in the opposite direction when said exerted forces are discontinued, said force controlling means containing a fluid sealed within a fluid system and at least a portion of said fluid being within said chamber sealed from the interior of the cylinder on the side of the piston opposite to the chamber.

6. The exercising device set forth in claim 5 wherein:

said fluid system comprises a normally closed valve engaged by the user to connect said fluid system to a source of air under pressure to charge said fluid system with air at a selected pressure when said force transmitting means is in an original position prior to applying exerted forces to the exercising device.

7. The exercising device set forth in claim 2 wherein:

said user interaction means comprises means for connecting a user gripping bar to said triangular frame at one of a number of angular positions.

8. The exercising device set forth in claim 2 wherein:

said rail is in a substantially horizontal position when an exerted force is first applied to said user interaction means.

9. The exercise device set forth in claim 2 wherein:

said means for selectively connecting the end of said piston rod to said rail comprises a universal joint.

10. The exercise device set forth in claim 2 in further combination with:

an associated bench adapted to accommodate an operator in supine, inclined and upright positions for exerting force on said user interaction means.

* * * * *